US006942790B1

(12) United States Patent
Dolton

(10) Patent No.: US 6,942,790 B1
(45) Date of Patent: Sep. 13, 2005

(54) OPEN-AIR FILTRATION CLEANING DEVICE FOR POOLS AND HOT TUBS

(76) Inventor: Edward Dolton, 189 Manorside Dr., Brick, NJ (US) 08724

( * ) Notice: Subject to any disclaimer, the term of this patent is extended or adjusted under 35 U.S.C. 154(b) by 0 days.

(21) Appl. No.: 10/865,421

(22) Filed: Jun. 10, 2004

(51) Int. Cl.[7] ..... E04H 4/16; B08B 1/00; B08B 9/36

(52) U.S. Cl. ..... 210/169; 210/86; 210/238; 210/242.1; 210/416.2; 210/460; 4/490; 15/1.7; 134/168 R

(58) Field of Search ..... 210/86, 169, 232, 210/238, 242.1, 459, 416.1, 460, 416.2; 15/1.7, 15/52.1; 4/490, 496; 134/168 R

(56) References Cited

U.S. PATENT DOCUMENTS

| | | | | | |
|---|---|---|---|---|---|
| 2,646,889 | A | * | 7/1953 | Dulak | 15/1.7 |
| 3,471,884 | A | * | 10/1969 | Wright | 15/28 |
| RE26,741 | E | * | 12/1969 | Myers | 15/1.7 |
| 3,886,616 | A | | 6/1975 | Hayes | 15/1.7 |
| 3,979,788 | A | * | 9/1976 | Strausak | 15/1.7 |
| 4,338,697 | A | | 7/1982 | Broadwater | 15/1.7 |
| 4,692,956 | A | | 9/1987 | Kassis | 15/1.7 |
| 4,786,334 | A | | 11/1988 | Nyström | 134/21 |
| 5,044,034 | A | | 9/1991 | Iannucci | 15/1.7 |
| 5,093,950 | A | | 3/1992 | Heier | 15/1.7 |
| 5,293,659 | A | | 3/1994 | Rief et al. | 15/1.7 |
| 5,351,355 | A | | 10/1994 | Chiniara | 15/1.7 |
| 5,435,031 | A | | 7/1995 | Minami et al. | 15/1.7 |
| 5,569,371 | A | | 10/1996 | Perling | 210/85 |
| 5,725,761 | A | * | 3/1998 | Phillips | 210/169 |
| 5,842,243 | A | | 12/1998 | Horvath et al. | 15/1.7 |
| 5,915,431 | A | | 6/1999 | Doussan | 15/1.7 |
| 5,933,899 | A | | 8/1999 | Campbell et al. | 15/1.7 |
| 5,961,822 | A | | 10/1999 | Polimeni, Jr. | 210/94 |
| 6,039,886 | A | | 3/2000 | Henkin et al. | 210/776 |
| 6,155,657 | A | | 12/2000 | Erlich et al. | 305/178 |
| 6,199,237 | B1 | | 3/2001 | Budden | 15/1.7 |
| 6,473,927 | B1 | * | 11/2002 | Sommer | 15/1.7 |
| 2001/0050093 | A1 | | 12/2001 | Porat | 134/8 |
| 2003/0132152 | A1 | | 7/2003 | Illingworth | 210/169 |

FOREIGN PATENT DOCUMENTS

| | | |
|---|---|---|
| FR | 2792021 | * 10/2000 |

* cited by examiner

*Primary Examiner*—Fred G. Prince
(74) *Attorney, Agent, or Firm*—Ernest D. Buff & Associates, LLC; Ernest D. Buff; Dave Narasimhan

(57) ABSTRACT

An open-air filtration device cleans swimming pools and hot tubs in an efficient, reliable manner. An open-air filter with a suction chamber unit comprises two scrubbing brushes and an impeller powered by a motor drive. Water containing debris is pumped to a level above the swimming pool or hot tub surface. The debris containing water is discharged through a spout into a filter tube. A filter element associated with the filter tube, and open to atmosphere filters the debris containing water by gravitational forces solely. The spout and filter tube are, optionally, attached to a pole that manually propels the suction unit. They may alternatively be attached to a floating platform that floats on the water surface of the pool or hot tub. If filter efficiency decreases, the water level in the filter tube rises, indicating that the filter element must be replaced. A rise in water level is visually observed or detected automatically and communicated using a visible or audible alarm.

9 Claims, 5 Drawing Sheets

OPEN-AIR FILTRATION CLEANING DEVICE FOR POOLS AND HOT TUBS

BACKGROUND OF THE INVENTION

1. Field of the Invention

The present invention relates to cleaning devices for removing debris from the bottom and side wall surfaces of swimming pools and hot tubs; and more particularly, to an open-air filtration cleaning device that dislodges the debris from such swimming pool and hot tub surfaces and forces the debris containing water through a filter at or near the pool water surface in a manner so efficient that debris dislodgement and filtering does not deteriorate as a function of pool filtration usage.

2. Description of the Prior Art

Many patents address issues related to pool and hot tub filters and scrubbing devices that loosen dirt from the pool walls and bottom surfaces. They employ either the high-pressure water from pool filter delivery line or an electrical motor to drive the scrubbing brushes, and pass the dirty water through the pool filter which may clog as a function of time thereby decreasing the pool filter operating efficiency.

U.S. Pat. No. 3,886,616 to Hays discloses a hand propelled swimming pool cleaner. It comprises a wheeled frame having a motor driven pump. The pump is adapted to pick up dirt particles from the pool floor and discharges the pumped water with debris through an accordion type filter within the device. An elongated handle is secured to the cleaning device to permit a person at poolside to manually maneuver the cleaner to clean the bottom of the pool. Since the filter in the device is within the motor driven cleaner and is in line with the pressurized water, any clogging of this filter reduces the filtering efficiency. It does not have any scrubbing brush and relies entirely on water flow to dislodge dirt particles from the pools' surfaces.

U.S. Pat. No. 4,338,697 to Broadwater discloses a simplified pool cleaning apparatus. The apparatus comprises a self-contained pool cleaning apparatus having a filter body with dirt and debris collectors positioned on the filter body front and back. During forward movement of the pool cleaning apparatus, the front debris collector is lowered to come into contact with the pool surface by rearward movement of a wheel assembly mounted on the filter body bottom and forward pressure exerted on the filter body by way of handle mounted on the filter body. At the same time, the rearward oriented debris collector is raised away from the pool surface. During backward movement of the pool cleaning apparatus, the wheel assembly moves forward relative to the center of the filter body, resulting in the back debris collector being lowered into operating position engaging the pool surface while the front debris collector is lifted away from the pool surface. During both forward and backward movement, the debris collectors collect dirt and debris carried by the pool water and pass them through a filtering zone. The filtering zone removes the dirt and debris from the pool water and the pool water exits through the top of the filter body. A foraminous partitioned insert and a cloth type filter element are provided within the filter zone for removing the dirt and debris. The disclosed device is manually operated with filters on the front and back sides and is designed to sweep dirt during forward movement and backward movement, respectively. The user can not readily detect filter clogging and there are no scrubbing brushes to loosen dirt adherent to the pools inner surfaces.

U.S. Pat. No. 4,692,956 to Kassis discloses a pool vacuum. This manually operated pool cleaning device is connected to water suction means and has a chamber with partitions wherein the flow of water rotates an agitation member that is fitted with bristles attached to it. The suction action carries debris loosened by the bristles with the pool water. The suction means and filtration means of the debris is not disclosed. Clogging of the filter may reduce suction significantly and will reduce or stop the rotation of the agitation member and the cleaning action of bristles.

U.S. Pat. No. 4,786,334 to Nystrom discloses a method of cleaning the bottom of a pool. The pool cleaner travels along the bottom of the pool and collects material lying on the surface thereof. The pool cleaner is arranged to travel to and fro in straight parallel paths between two opposite walls of the pool using a self-propelled motorized drive mechanism. At the walls the pool cleaner is turned by rotating a half turn so that, after turning, it will have been displaced laterally perpendicular to the initial direction of travel. This motorized device has a drive motor, a pump connected to the motor, and two brushes driven by the motor. The dislodged debris and the pool water mixture are pulled into the pump inlet and are filtered at the pump outlet. The pool cleaner has only a single collection means due to the single travel path of the pool requiring a low capacity pump. When the filter at the pump exit clogs the water suction is reduced, even when the brushes operate effectively. In this automatic self-propelled pool cleaning device the clogging of the filter and subsequent loss of cleaning efficiency are essentially undetectable.

U.S. Pat. No. 5,044,034 to Iannucci discloses a swimming pool vacuum cleaner with a rotary brush. The swimming pool vacuum cleaner has a water-powered turbine and a rotary brush directly and rigidly connected to the turbine so that rotation of the turbine imparts corresponding rotation to the rotary brush. A stationary brush partially surrounds the rotary brush and a foraminate screen is positioned upstream from the brushes to trap residue loosened by the brushes. The swimming pool vacuum cleaner is entirely powered by the external suction of water and means of this suction is not disclosed. The debris loosened by the brush is collected in the foraminate screen positioned upstream from the brushes. As the debris accumulates on the surface of the foraminate screen, clogging occurs. Suction efficiency is reduced and the drive turbine slows down.

U.S. Pat. No. 5,093,950 to Heier discloses a self-propelled vacuum driven swimming pool cleaner. The self-propelled vacuum driven swimming pool cleaner has an outer cover or shroud. The shroud contains a vacuum motor driven by a pool water recirculation system and is connected to a reduction gear train, to rotate a brush assembly, that frictionally engages a surface to be cleaned, and propels the cleaner while scrubbing and then vacuuming loosened dirt and debris from the surface. The pool recirculation system has to filter the debris scrubbed by the self-propelled vacuum driven swimming pool cleaner. When the filter in the pool recirculation system clogs, the efficiency of the vacuum water suction is reduced. This, in turn, reduces the speed of the vacuum water motor that provides self propulsion and scrubbing action.

U.S. Pat. No. 5,293,659 to Rief et al. discloses an automatic swimming pool cleaner comprising a suction head having a housing that is open at its lower side and inclined bristles attached to its' lower edge for support on the cleaning surface. The housing has a rotary sleeve mounted to its' top for the connection of a suction hose in turn to be connected to a water suction pump. Said sleeve opens into a chamber within the housing in which a vibratory element is pivotally mounted, said element having a crescent or air-foil shape. By a flow of water sucked through said chamber, the vibratory element is automatically brought into a vibrating movement which imparts pulsations on the suction head. Thereby, the inclined bristles are bent and straightened repetitively, resulting in a forward thrust moving the suction head over the surface to be cleaned. At least one foot is disposed in the housing which is cyclically displaced vertically by a driving mechanism driven by the movement of the vibratory element and returned by return springs. Said foot cyclically lifts off the suction head at one side, resulting in a rotational movement of the suction head about a vertical axis so as to change the direction of forward movement of the suction head. The disclosed device is operated by water (vacuum) suction which causes a brush to vibrate promoting scrubbing action. The loosened dirt together with the pool water is carried by water suction and has to be cleaned by a filter at the water (vacuum) suction unit. Filter clogging results in reduced water (vacuum) suction and poor movement of vibratory debris dislodging devices.

U.S. Pat. No. 5,351,355 to Chiniara discloses a swimming pool cleaner. The majority of currently available submersible swimming pool cleaners operate in a random manner, following no set path of travel along the bottom of a swimming pool. As a result, a lengthy period of time and a large amount of power consumption are required to clean an entire swimming pool. This problem is resolved by using a submersible swimming pool cleaner, comprising a casing that tapers from one end to the other thereof, a pair of wheels at the wide end of the casing, a single wheel at the narrow end of the casing, a drive system for driving each of the wheels, a cable for connecting the cleaner to a fixed point on one side of the pool, and a cable tensioning device. This cable tensioning device is found within the casing and is utilized for changing the length and tension on the cable whereby the cleaner is caused to follow a predetermined path of travel over the entire inside area of the swimming pool. The swimming pool cleaner is pumped by water (vacuum) suction with an in line filter to remove collected debris. It has two drive wheels on one side and a single drive wheel on the other side driven by a mechanical drive creating a path of motion. There are two rotating scrub brushes on either side of the device. The scrubbing action dislodges the debris and which is then sucked with the pool water and filtered by the in-line filter. When the filter clogs the suction efficiency is significantly decreased. This filter clogging is not easily perceived in this automatic pool cleaning device and therefore the lack of optimal cleaning may not be readily realized.

U.S. Pat. No. 5,435,031 Minami, et al. discloses an automatic pool cleaning apparatus for automatically cleaning submerged surfaces, such as the bottom and sidewalls of a swimming pool. The apparatus includes onboard sensors, and an onboard microprocessor which controls the operation of the apparatus in response to status information supplied from the sensors. The apparatus has an onboard watertight battery and an adjustable inlet nozzle size, and includes left and right track treads which are controllable to enable the apparatus to turn or rotate (clockwise or counterclockwise), or translate in a forward or reverse direction, on a horizontal or vertically inclined submerged surface. A transmission assembly is provided for each track tread, including a cam wheel and a cam follower connected thereto within a sealed control assembly, and a shift link extending through a seal in the control assembly. The apparatus also includes Hall Effect transducers with associated permanent magnets and a microprocessor programmed to execute the selected cleaning program, chosen from a number of available cleaning programs encoded in a punch card. It uses a water suction attachment and a turbine to provide movement. A roller brush powered by the turbine scrubs the swimming pools inner surfaces and the debris containing water is removed through the suction flow stream and filtered. The unit is buoyancy controlled and has the ability to turn in any direction, and thereby matching the pool surface for scrubbing action. Any clogging in the filtering device in the water suction flow stream will reduce the operational efficiency of the turbines and the scrubbing brush.

U.S. Pat. No. 5,569,371 to Perling discloses a system for underwater navigation and control of a mobile swimming pool filter. The underwater navigation and control system for a swimming pool cleaning robot comprises a driver, an impeller, a filter, a processor for controlling the driver, and a signal-producing circuit. The system further includes a signal- detecting circuit mounted on the pool, an interface located on the ground in proximity to the pool, and a detector for receiving and processing data from the detecting circuit and for transmitting signals to the robots processor. Determination of the actual robot location is performed by triangulation in which the stationary triangulation base is defined by at least two spaced-apart signal detectors and the mobile triangle apex is constituted by the signal-producing circuit carried by the robot. The robot is powered by two electrical motors with each motor driving a pair of traction scrubbing brushes. An impeller is used to draw the pool water containing scrubbed debris which is filtered immediately upstream. After filtration, the filtered pool water is returned to the pool. This submerged robot collects all the scrubbed debris in the upstream filter and is subject to clogging. Even though the motors drive the scrubbers and the impeller, the clogged filter prevents efficient filtration of the pool water.

U.S. Pat. No. 5,842,243 to Horvath, et al. discloses a manually propelled pool cleaner. The self-contained manually propelled pool cleaner moves on wheels positioned inboard of the housing, the wheels being supported by axles that extend laterally across the entire width of the housing and are secured at their ends to the side walls and along their length to the lower periphery of the front and rear walls to provide structural integrity and rigidity to the housing. The base plate is provided with pivoting brushes extending diagonally across the direction of travel to move debris towards the intake ports for entrainment in a disposable filter bag. A pivoting off-set connector permits the operator to control the direction of movement by axially twisting the handle while pushing or pulling the cleaner. Electrical power to operate the water pump(s) is supplied from an airtight floating battery case that is tethered to the pool cleaner. This battery powered manually propelled pool cleaner has a motor, a pump, and a scrubbing brush for pumping debris containing pool water through a disposable filter. The clean filtered pool water is released through two ports above the submerged device. When the disposable filter clogs, the user is unaware of the decreased filtering efficiency since the motor continues to pump and drive the scrubbing brushes.

U.S. Pat. No. 5,915,431 to Doussan discloses a pool cleaning apparatus. The pool cleaning apparatus includes a head having a forward portion and a rearward portion, a debris reservoir detachably connected to the rearward portion of the head, a first deflectable blade detachably connected to a lower end of the forward portion of the head being movable downwardly to engage a surface of the pool in response to water flow in the direction of the debris reservoir, and a bracket for connecting a handle to the head. The forward manual movement of the device by the user engages a blade against the pool inner surface scrubbing and loosening debris. The water flow directs the debris containing pool water rearward, where it is filtered in a debris reservoir. There is no water drive or pump suction attached to the device, and therefore there is not a continuous flow of water. When the filter clogs, there is no possibility of debris filtration.

U.S. Pat. No. 5,933,899 to Campbell, et al. discloses a low pressure automatic swimming pool cleaner operating with a pool cleaning system which is not equipped with a booster pump. The apparatus comprises a frame having a forward end and a rearward end with a water inlet mounted on the frame and receiving a supply of water through an inlet. The inlet may comprise a supply mast having a number of openings for supplying water to the various components of the cleaner. The frame is carried on a plurality of transport wheels mounted on the frame. The apparatus further includes a vacuum system including a collection bag positioned on a suction mast having water injection ports positioned such that at least one opening in a water injection port injects water into the collection bag to create suction and draw debris into the bag. A drive system is provided to move the apparatus around the pool. The drive system includes a turbine having a plurality of vanes rotating and mounted in turbine housing. The turbine housing has a first water input and a second water input each oriented to allow a stream of water passing to impact an individual vane at the same angle of incidence as the vane passes through the stream. A drive axle couples to the turbine and at least one set of the plurality of transport wheels. In a further aspect the drive system may include thruster jets positioned on the mast adjacent to the rearward end of the frame. This device is propelled by a turbine driven by a supply of low-pressure water and the collected debris is collected by vacuum suction into a collection bag attached to the swimming pool cleaner. Any blockage of the filter, which decreases the suction and thereby prevents the pool cleaner from sucking the debris in the pool water, is essentially unknown to the pool user.

U.S. Pat. No. 5,961,822 to Polimeni, Jr. discloses a pool cleaner. The pool cleaner floats on the surface of a pool. The cleaner includes a pump and filter, the filter being connected to the discharge side of the pump. The inlet of the pump is connected to a vacuum hose, which is manually moved around inside the pool to suck up debris by directing water from the pool through the pump and filter. Due to the absence of any filter on the suction or inlet side of the pump, the cleaner maintains its efficiency for a longer time. The cleaner may also include a rotary strainer, placed on the discharge side of the pump, for removing large pieces of debris. The strainer includes a slide-able, transparent access cover, which allows visual monitoring of the condition of the strainer, and permits easy access to the interior of the strainer, for removal of debris. The device only removes loose debris from the pool and does not scrub the pool interior surfaces to loosen adhered debris. Since the filter is on the discharge side of the pump it may become clogged and the pump will no longer suck debris efficiently. Furthermore, clogging of this filter is not detected easily by the pool user.

U.S. Pat. No. 6,039,886 to Henkin, et al. discloses a water suction powered automatic swimming pool cleaning system. The automatic swimming pool cleaner is driven by a source of negative pressure, such as an inlet of a pool pump, and is utilized for cleaning the interior surface of a containment wall and the upper water surface of a swimming pool. The automatic swimming pool cleaner includes a unitary body suited for immersion in the swimming pool and a negative pressure source, for producing a water flow in the body, connected by a hose from the pool pump to the chamber. It has a location control subsystem that uses the water flow for producing a vertical force to selectively place the body either (1) proximate to the water surface or (2) proximate to the wall surface below the water surface. The automatic swimming pool cleaner is manually pulled to clean the pool water surface or the pool's inner walls. The cleaner body has a weight/buoyancy characteristic to cause it to naturally rest either (1) proximate to the pool bottom adjacent to the wall surface (i.e., heavier-than-water) or (2) proximate to the water surface (i.e., lighter-than-water). The buoyancy controlled device has no scrubbing brushes and sucks only loose debris, relying strictly on the pool filter to remove the debris. When the pool filter becomes clogged, the device no longer sucks any debris. The clogging of the filter is not observed by the pool user.

U.S. Pat. No. 6,155,657 to Erlich, et al. discloses a drive track for a self-propelled pool cleaner. The submersible self-propelled pool or tank cleaner includes a pair of moving, driven, endless belts or drive tracks mounted on axles, which carry two cleaning brushes. The driven endless belts are provided with moving side-projecting elements that extend from either the moving drive track or the drive wheels, or both, in order to contact the side wall of the pool and other projecting structural elements in the pool. Furthermore, the moving side-projecting elements prevent the stationary structural elements of the pool cleaner from being damaged by scraping the side of the pool and prevent the hard plastic of the cleaner housing from damaging lightweight swimming pool liners. The drive track or belt is provided with raised transverse rib members that terminate into a tip that projects beyond the edge of the belt and extends beyond the projected line of structural elements along the side of the pool cleaner. The hub of the drive wheels around which the belt passes is provided with an extension member that extends outwardly from the hub perpendicular to the longitudinal axis of the cleaner and the direction of travel, a distance that is sufficient to permit the extension member to contact the side and/or bottom of the pool and to prevent the fixed structural elements of the cleaner from contacting the side wall and/or bottom of the pool. It is unclear how the self propelled pool cleaner is driven or what happens to the debris that has been scrubbed. It appears that the scrubbed debris becomes a part of the pool water and has to be eventually filtered by the pool pump and cleaner.

U.S. Pat. No. 6,199,237 to Budden discloses an underwater vacuum. The underwater vacuum includes a housing having an opening which is positioned adjacent the surface to be cleaned. The housing also supports a rotating brush powered by a turbine energized by suction water flow from the pool pump through the underwater vacuum. The housing has a water outlet, which communicates with the suction of the pool's pump at the surface of the water. The inlet to the turbine has a trap which collects large debris that could damage the turbine blades. The vacuum has two rear wheels that are adjustably attached to the interior of the housing, and two front wheels that are adjustably attached to the exterior of the housing. The underwater vacuum can remove sediment from a water storage reservoir without causing turbidity in the water column. A second handheld embodiment is used for cleaning sloping berms, and has rear wheels that are also powered by the turbine. The manual pool vacuum device has a turbine that is powered by suction water flow by a pool pump at the surface of the pool. The turbine is used to power brushes and to drive the rear wheels. Large debris is filtered at the suction inlet of the device but all the fine sediments are carried to the pool vacuum filter. Any clogging of the pool pump filter results in decreased water flow through the underwater vacuum resulting in reduced efficiency in sediment removal. This clogging event is not observed by the manual user.

U.S. Pat. No. 6,473,927 to Sommer discloses a swimming bath cleaning device. The device has a housing with an intake aperture arranged on the base of the housing through which a liquid to be cleaned is conveyed. The liquid is conveyed by means of a pump into an inner chamber partially enclosed by the housing and by a filter separating a contamination-exposed part from a clean part of the inner chamber. The cleaned water is returned to the pool through a motor suction pump, which may or may not be the pool cleaning pump. The swimming bath cleaning device has scrubbing brushes. There is no means to power the brushes or to propel the manually operated device. When the filter clogs the suction of debris becomes inefficient.

U.S. Patent Application 2001/0050093 to Porat, Joseph discloses a motion detection and control for automated pool cleaner. The automated power-driven pool cleaning apparatus is provided with a motion translating member (MTM) that contacts the surface being cleaned, an associated signal transmitter, and a sensor. The sensor is connected to the pool cleaner's programmed electronic control device, or chip, so that when the cleaner is moving, the MTM moves the signal transmitter past the sensor thereby providing an intermittent signal. When the cleaner stops moving, no intermittent signal is received and after a predetermined period of time, the control device causes the cleaner's drive means to move the cleaner in a different direction. This programmed motion translation member controls the movement of a pool cleaning device. There is no disclosure on a specific pool cleaning device.

U.S. Patent Application 2003/0132152 to Illingworth, Lewis discloses a vortex pool cleaner. The improved pool cleaner utilizes toroidal vortex technology to provide efficient fluid flow in a sealed system, creating a low pressure region which attracts debris. The debris free liquid is returned through the annulus. More specific to the separation chamber, a cylindrical vortex is formed such that a circular pattern of flow exiting from the impeller spirals downward along the chamber's outer wall, and then upward along the chamber's inner wall. At the top of the chamber's inner wall is the opening leading fluid out of the chamber and into the annular duct between the outer and inner tubes. The circular flow of the fluid acts as a centrifuge, forcing the higher mass dust particles outward. The spiraling liquid also creates a pressure in the dust collector that is above that in the body of the separation chamber due to kinetic energy of the circulating fluid. This higher pressure pushes the spiraling air inward, maintaining the fluid's circular path. However, the dust particles are not inhibited from traveling straight into the collector. The sealed system prevents dirt from escaping into surrounding fluid and retains kinetic energy of the flowing fluid. The present invention is also quieter, lighter, and simpler than conventional designs. However, this vortex pool cleaner does not have a scrubber to loosen debris from the pool walls. Furthermore, any debris collected stays within the outer chamber of the vortex swimming pool cleaner and collects there with no discharge possibility.

There remains a need in the art for a reliable, long lasting, trouble free cleaning device for pools and hot tubs that utilizes brushes to scrub and remove adhered debris from the walls thereof while collecting and separating debris from the water with minimal clogging of the filtration device, while maintaining substantially constant the scrubbing, suction, and filtration efficiencies of the device as functions of use time.

SUMMARY OF THE INVENTION

The present invention provides an open-air filtration pool cleaning device for pools and hot tubs that is highly reliable in operation, and provides essentially trouble-free cleaning of pool and hot tub surfaces for a prolonged period of time. A plurality of brushes scrub and remove adhered debris from such pool and hot tub surfaces. The debris is then collected and transported to a filtration device, wherein it is separated from the water in an essentially clog-free operation. Scrubbing, suction and filtration efficiencies are increased and cleaning times are decreased. The pool and hot tub surfaces are cleaned quickly and easily, at low cost in a highly reliable manner.

Generally stated, the apparatus comprises a suction chamber, dual scrubbing brushes rotating in opposing directions, and a horizontal impeller. The horizontal impeller forces pool water containing the scrubbed debris through an opening positioned on the top of the suction chamber. Water passing through the opening moves into a flexible tube that connects to a floating, open filtration, device. The filtration device filters debris containing pool water by way of an open-air filter, utilizing gravitational forces. The bottom portion of the suction chamber is composed of flexible rubber-like material having several cut outs to permit entry of pool water into the suction chamber. The flexible rubber like elements at the bottom of the suction chamber bring the brushes in close proximity to the pool surface even when the side walls of the pool are being scrubbed and cleaned, manipulated manually by means of a pole handle attached to the suction chamber or automatically by a conventional state of the art drive mechanism. As thus described, the apparatus is especially suited for cleaning swimming pools, hot tubs, fishponds, decorative water falls or like water containments, which require periodic cleaning.

The open-air filtration cleaning device is entirely powered by the drive which may be an electrical motor or a hydraulic motor, such as a water turbine. The electrical motor is fully protected for operation under water such as that used in submersible immersion pumps. The hydraulic motor is powered by a separate supply of clean water such as that provided by a garden hose. The hydraulic motor may discharge water into the pool providing make-up water. Each of the dual brushes is driven by a belt, which is preferably a timing belt, configured to rotate the scrubbing brushes in opposition so that debris collects within the suction chamber in-between the scrubbing brushes. A horizontal rotating impeller, driven by the same drive, sucks up the debris containing water and pushes it through an opening on top of the suction chamber. The water is moved by the horizontal rotating propeller into flexible tubing in communication with an open-air filtering unit located above the water line that is floating on the surface of the pool water. Alternatively, the flexible tubing may be connected to an open air filtering unit integral with or appended to the pole handle that is attached to the suction chamber. Open air filtration of water containing debris is accomplished by gravity exclusively; whereupon, the filtered and cleaned pool water is discharged into the pool. Decreases in efficiency of filtration, cause the water level in the open to air filtering unit to rise. When, eventually, the filter overflows that the operator is alerted that the filtering element should be changed. Access to the open-air filter is facilitated by its close proximity to the user; hence, any clogging of the filter is immediately detected, and readily remedied. In a second embodiment, an alarm may be incorporated to sound off when the water level rises beyond a set height.

The key features of the open-air filtration cleaning device include, in combination, the features set forth below:

1. A suction chamber for collecting and discharging scrubbed debris in swimming pool or hot tub water;
2. The suction chamber comprising flexible elastomeric elements having cut out pathways in a bottom region contacting an inner surface of the swimming pool or hot tub, thereby enabling free flow of pool water into the chamber;
3. The suction chamber being mounted on four wheels for manual or automatic propulsion of the cleaning device;
4. The suction chamber having an enclosed mechanical drive source which comprises an electrical motor or hydraulic motor;
5. The mechanical drive rotating two scrubbing brushes mounted on the bottom of the suction chamber in opposing directions and scrubbing the pool's inner surface;
6. The suction chamber having a horizontal rotating impeller positioned above the scrubbing brushes and powered by said mechanical drive;
7. The horizontal impeller sucking scrubbed debris with pool or hot tub water and discharging it into a flexible tubing outlet;
8. The flexible tubing outlet connecting to a floating platform or alternatively connecting to an open air filtering unit integral with or appended to the pole handle that is attached to the suction chamber which discharges debris containing water into an open air filtering tube with replaceable filter elements,
9. The open air filtering tube discharging filtered clean water into the pool or hot tub,
10. The water level in the replaceable filter element and the open air replaceable filtering tube being monitored to detect any decrease in the water filtering efficiency; and
11. The filter element being disposed in close proximity to the operator, facilitating its replacement when a decrease in filtering efficiency is observed.

BRIEF DESCRIPTION OF THE DRAWINGS

The invention will be more fully understood and further advantages will become apparent when reference is had to the following detailed description of the preferred embodiments of the invention and the accompanying drawing, in which.

DETAILED DESCRIPTION OF THE INVENTION

Figure 1:
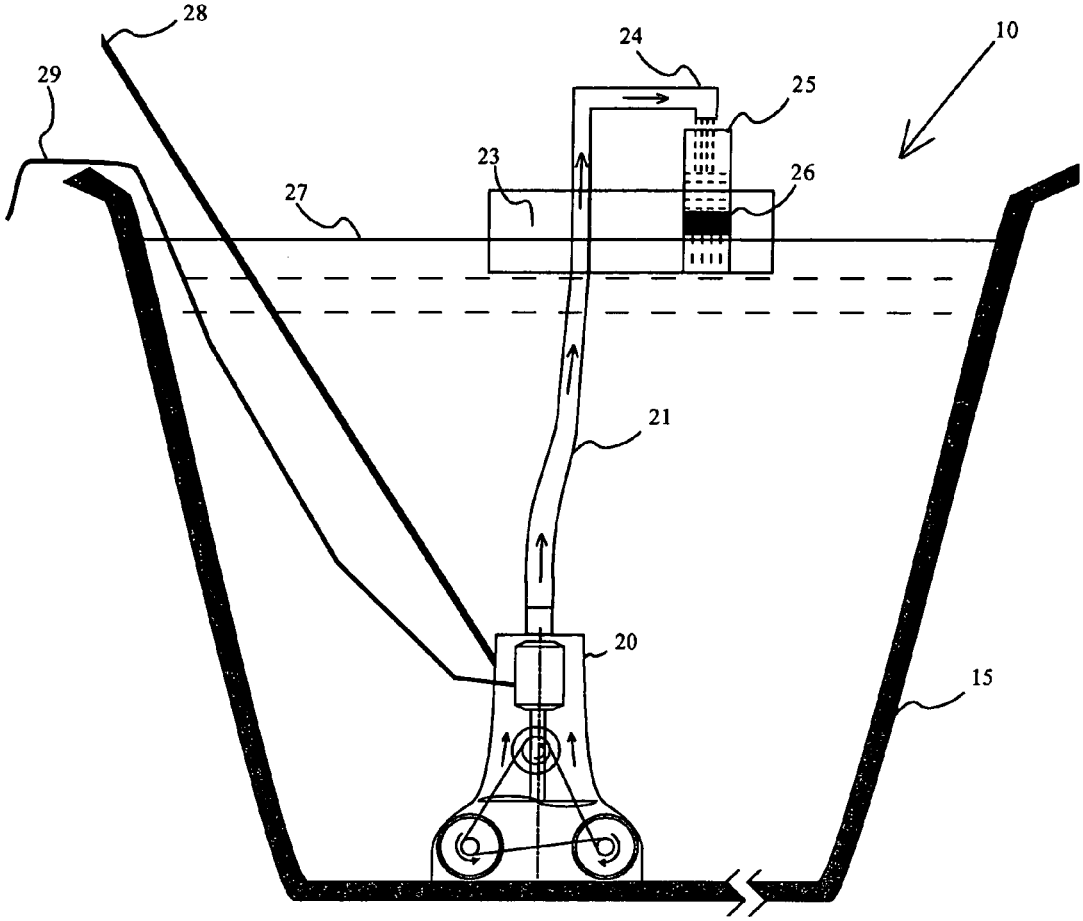
FIG. 1 is a diagrammatic representation of an open-air filtration cleaning device in an operable position on the bottom surface of a swimming pool, with an electrical or hydraulic (i.e. garden hose) power supply connected to the drive motor that rotates the scrubbing belts and an impeller, so that the debris containing water is filtered through a floating open-air filtration unit located atop the surface of the pool's water.

Pool cleaners rely on a filter to remove sediments from the pool water. These sediments may be organic substances, including leaves and other debris, as well as inorganic substances, such as sand. Pool cleaners use a high pressure pool pump forcing debris containing water through a sand filter bed, thereby removing the debris from the water and returning the filtered clean pool water back into the pool. Typically these filters force water through the sand bed or DE filter using diaoginous earth at a pressure of 50–80 psi and filter clogging is observed by increase in back pressure. Today, most sand filter units have been replaced. Unfortunately, heretofore disclosed and utilized pool cleaners do not use scrubbers to clean the pools' inner wall surfaces and therefore these cleaners do not remove debris which has adhered to these surfaces. Pool scrubbers dislodge the debris from the surfaces, leaving the newly loosened debris to mix in with the pool water, making the pool water murky. Due to the excessive debris contained in the pool water it takes a long time to filter the water and clogging of the filtration unit frequently results. On the other hand, some of the pool wall surface scrubbers collect and discharge debris-containing water into the inlet of the pool cleaner pump. This inevitably results in clogging of the pool's filter. The scrubbers powered by water suction cease to work, and the filter's capacity to remove the scrubbed debris deteriorates. The problem is exacerbated if the pool wall scrubbers carry their own filter; since the clogging of these filters and consequent loss of cleaning efficiency are undetected by the user.

Generally stated, the present invention provides an open-air filtration cleaning device that may be used to clean swimming pools or hot tubs, or any like water containment structures. The open-air filtration cleaning device comprises a suction chamber. Preferably, the suction chamber creates its own suction by the action of a rotating impeller driven by a motor drive unit contained within the suction chamber. The suction chamber is mounted on four wheels attached to tow axles and houses two scrubbing brushes positioned directly below the impeller, which are rotated in opposing directions and powered by a belt connected to the drive unit. The suction chamber is also provided with a flexible bottom made from a resilient material, such as rubber, with a multitude of openings for entry of pool water into the suction chamber. The impeller rotation discharges debris containing pool water through an opening located on the top of the suction chamber into a flexible hose that connects to a floating filtration unit. Since the height of water in the pool is typically 15 feet or less, only 7 psi of pressurization needs to be created by the rotation of the impeller. The floating filtration unit receives the debris containing water and passes it through an open filtration chamber that filters the debris containing water using gravitational force solely, and returns the filtered water into the pool. An appreciable reduction in filtration efficiency of the filter causes the water level in the filter to rise. This condition is easily detected by the user of the clog resistant pool cleaning device. The filter element can be easily replaced and the filtration efficiency readily restored. In an alternative embodiment, the water level in the filtration unit is monitored. When the water level reaches a preset value, an alarm is triggered to alert the operator that replacement or restoration of the filtration unit is required.

The open-air filtration cleaning device is entirely powered by the drive unit. Such a drive unit can comprise an electrical motor or a hydraulic motor, such as a water turbine. The electrical motor is fully protected for operation under water, such as units used in submersible immersion pumps. The hydraulic motor is powered by a separate supply of clean water, typically provided by a garden hose. The hydraulic motor may discharge water into the pool providing make-up water. The drive to the brushes is provided by a belt drive, which may be a timing belt configured to rotate the scrubbing brushes in opposition so that debris collects inside the suction chamber in between the scrubbing brushes. A horizontal rotating impeller, driven by the same drive, draws up the debris containing water and forces it through an opening on the top of the suction chamber into flexible tubing that connects to a filtering unit that is floating on the pool water surface. The open to air filtering unit filters debris containing water only by gravity and discharges cleaned pool water into the pool. If there is any decrease in efficiency of filtration, the water level in the open-air filtering unit rises; until eventually the filter overflows, indicating that the filtering element in the filter needs to be changed. In a second embodiment, an alarm may be incorporated to provide an audible or visible signal when water level rises beyond a set height.

Referring to FIG. 1, there is shown generally at 10 a swimming pool 15 with a scrubbing unit suction chamber 20 having four wheels, two scrubbing brushes and an impeller, all driven by a single drive unit. The suction chamber 20 discharges water containing debris, which passes through a flexible hose 21 that attaches to a floating platform 23. The floating platform 23 has a spout 24 which discharges the water containing debris into an open-air filtration tube 25, which is fitted with a filtration element 26. The filtered water discharges directly below the filtration element 26 and the liquid level in the filtration tube 25 is maintained by the balance between the amount of water containing debris passing through the spout 24 and the amount of filtered water discharged from the filtration element 26. Any reduction in filtration efficiency will result in increased water levels in the filter tube 25 and may even lead to overflow, signaling that the filter element 26 should be replaced. The scrubbers and impellers continue to work efficiently despite reduction in filtration efficiency and the debris containing water is returned to the pool water due to the overflow of the filter tube 25. The suction chamber 20 is pulled by a pole 28 attached to the suction chamber's 20 side wall. The connection 29 provides power to the motor drive unit in the suction chamber 20 which may be driven by an electrical power cord connected to a rechargeable battery or by a hydraulic power cord connected to a garden hose.

In one embodiment, a filter tube 25 has a diameter of 6 inches (150 mm) and a water level height of 6 inches (150 mm). The velocity of water through tube 25 with no filter is 5.68 feet per second (173 cm/sec). The volume discharged by the 6 inch (150 mm) diameter filtration tube is 2.08 gallons/sec (7.9 lit/sec). The filter restricts the flow by 75 percent, causing the flow rate of filtration to be 0.5 gallons/sec (1.9 lit/sec). The weight of water in the filtration tube 20 is 6.12 pounds (2.78 kg), which is easily handled by the floatation platform. In a second embodiment of the invention, the filter tube 20 is directly attached to the end of pole 28. This presents no problem in manipulating the suction chamber 20, owing the reduced weight of water in the filter tube 20 at 6 pounds (2.78 kg).

Figure 2:
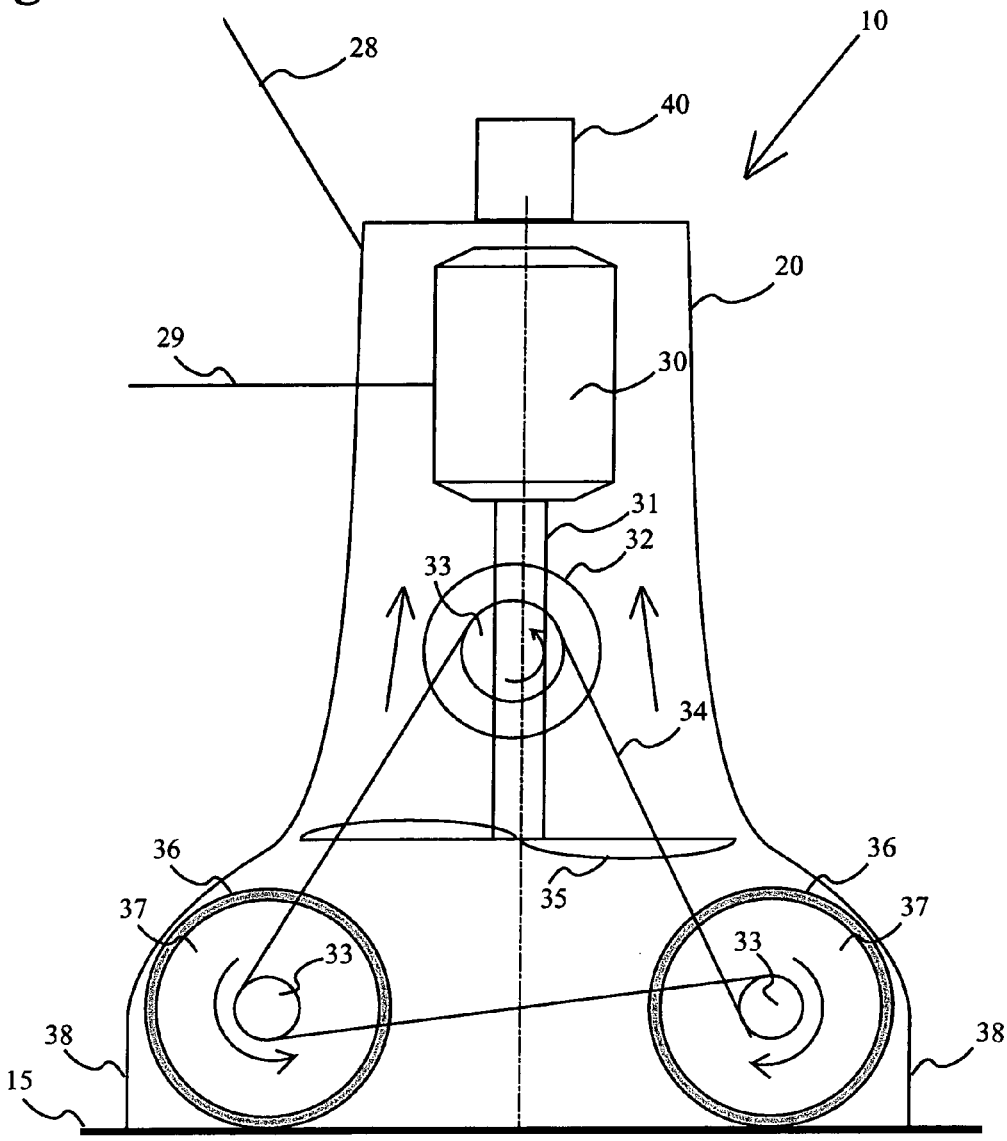
FIG. 2 is a diagrammatic representation of a front view of the scrubbing unit of the open-air filtration cleaning device.

Referring to FIG. 2, there are shown generally at 10 the details of the front view of the suction chamber 20. The suction chamber 20 has a metallic or polymeric shell and a flexible rubber or elastomeric element 38 at the bottom, which may have a multitude of openings 39 for entry of pool water into the suction chamber 20. A motor 30, which may be electric or hydraulic, is mounted within the suction chamber 20 with a shaft 31 driving a right angle drive 32 and an impeller 35. The motor 30 is powered by supply line 29. The right angle drive 32 has a shaft on which a belt drive pulley 33 is mounted and connects to two pulleys 33 mounted on scrubbing brushes 36. The belt drive rotates the scrubbing brushes 36 in opposition, while the wheels are unattached to the scrubbing brush 36, and are thereby free to rotate when the suction chamber 20 is pulled using pole 28. In another embodiment, the four wheels may be geared to provide automatic propulsion of the suction chamber 20 or propulsion assist for climbing the side walls of the swimming pool.

Figure 3:
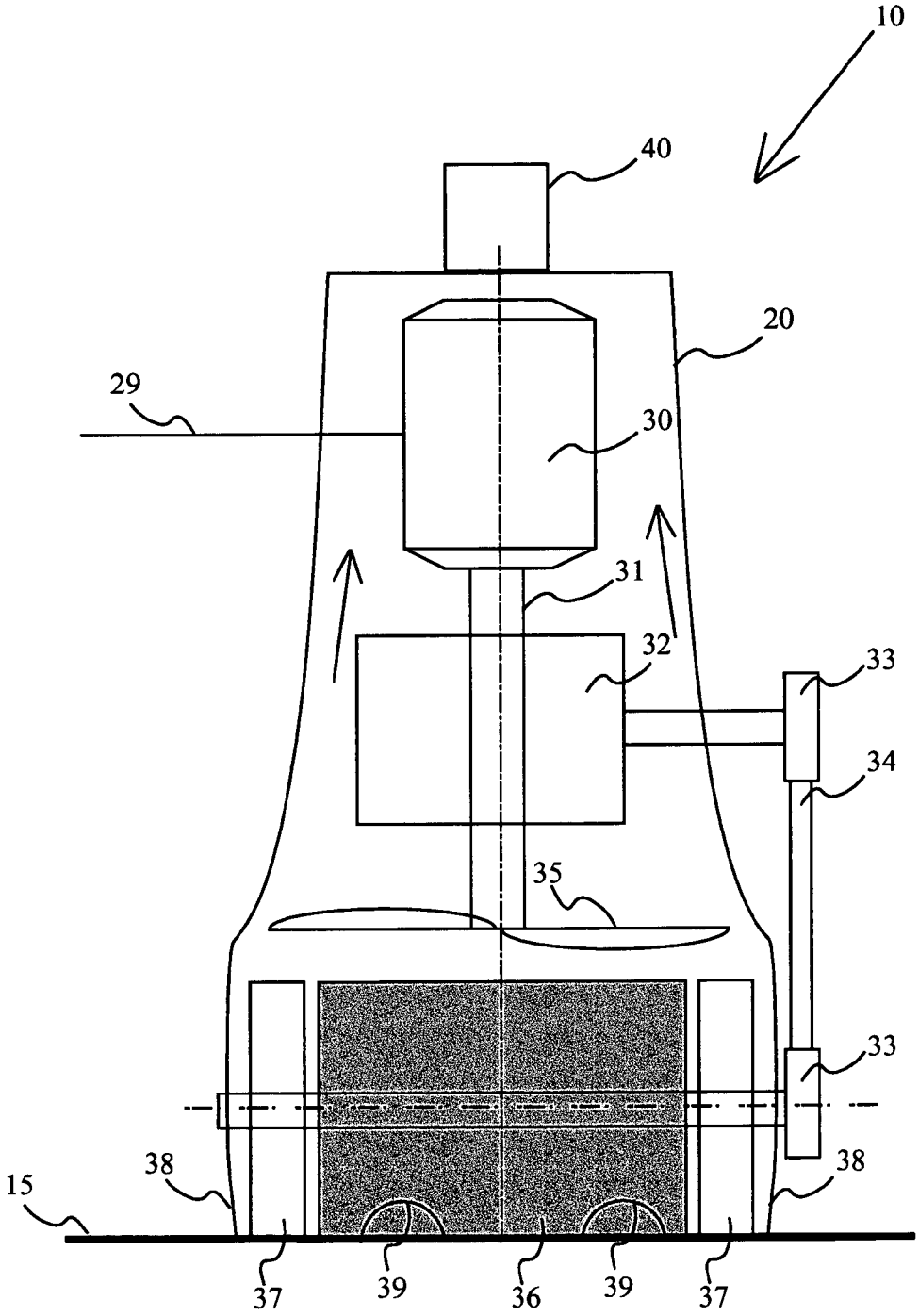
FIG. 3 is a diagrammatic representation of a side view of the scrubbing unit of the open-air filtration cleaning device.

Referring to FIG. 3, there are shown at 10 the details of the side view of the suction chamber 20. The suction chamber 20 has a metallic or polymeric shell and a flexible rubber or elastomeric element 38 at the bottom, which may have a multitude of openings 39 for entry of pool water into the suction chamber 20. A motor 30, which may be electric or hydraulic, is mounted within the suction chamber 20 with a shaft 31 driving a right angle drive 32 and an impeller 35. The motor 30 is powered by supply line 29. The right angle drive 32 has a shaft on which a belt drive pulley 33 is mounted and connects to two pulleys 33 mounted on scrubbing brushes 36. The belt drive rotates the scrubbing brushes 36 in opposition, while the wheels 37 are unattached to the scrubbing brushes 36, and thereby free to rotate when the suction chamber 20 is pulled using pole 28.

Figure 4:
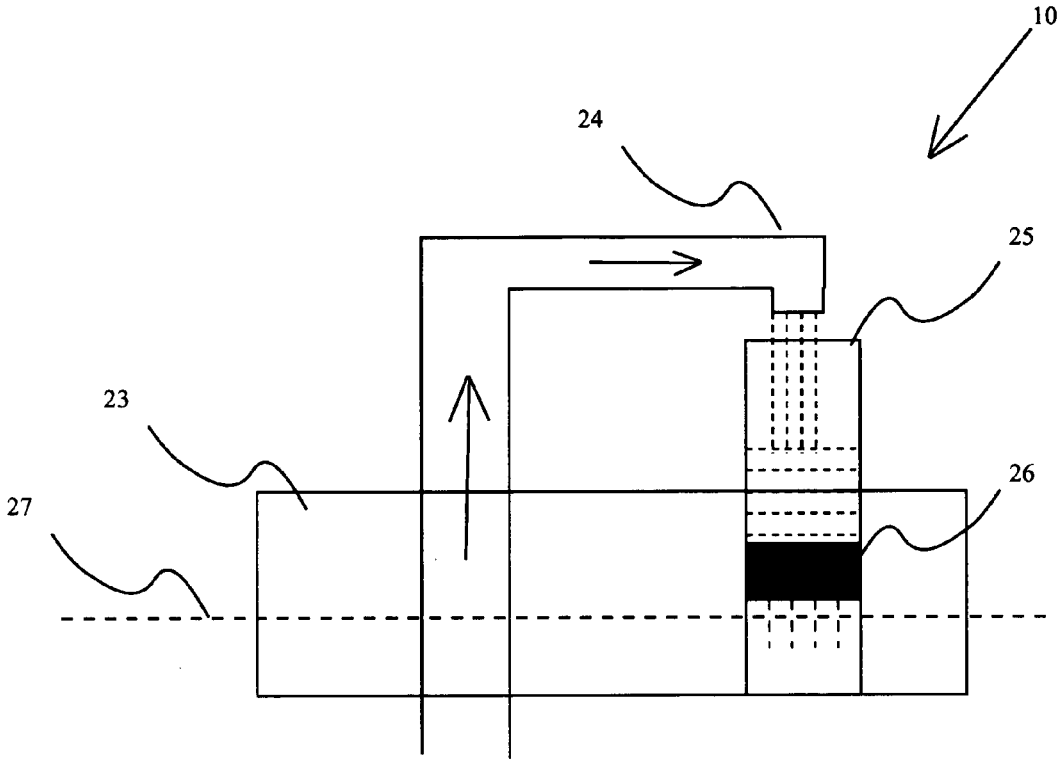
FIG. 4 is a diagrammatic representation of a floating filtration unit of the open-air filtration cleaning device.

Referring to FIG. 4, there are shown at 10 the details of the floating open-air filtration tube 25. The floating open-air filtration tube 25 receives debris-containing water from below through a flexible hose 21 connection. The water containing debris comes up through the flexible hose 21 and exits through a spout 24. The water containing debris is received by the floating open-air filtration tube 25, which has a filter element 26. The filtration of the water containing debris occurs by gravitation force only and discharges the filtered water down below into the swimming pool. The spout 24, the filtration tube 25, and the filter element 26 are attached to the flotation platform 23, which floats above the water line 27 in the swimming pool.

Figure 5:
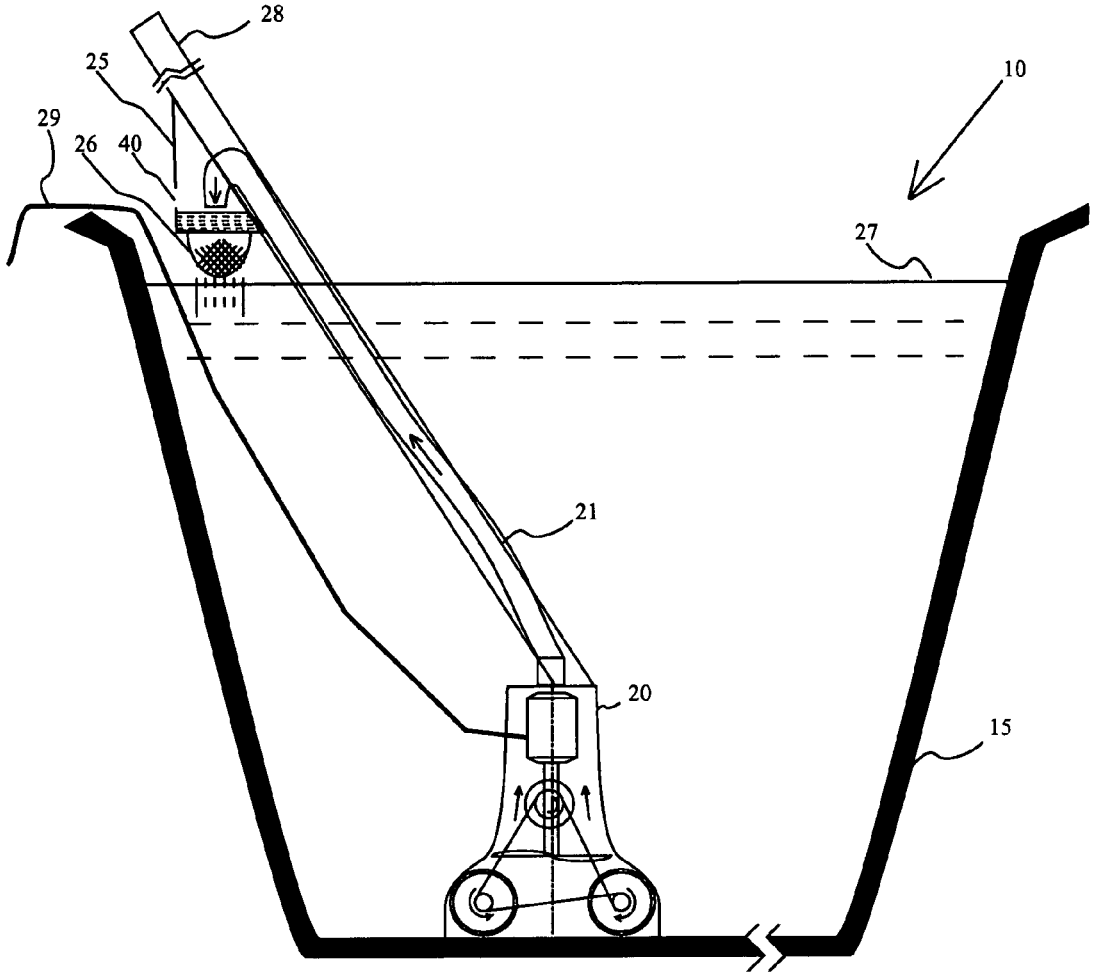
FIG. 5 is a diagrammatic representation of an open air filtering unit integral with or appended to the pole handle that is attached to the suction chamber.

Referring to FIG. 5, there is shown generally at 10 a swimming pool 15 having a scrubbing unit suction chamber 20 that comprises four wheels, two scrubbing brushes and an impeller, all driven by a single drive unit. The suction chamber 20 discharges water containing debris. Such debris passes through a flexible hose 21 within the pole 28, which is used to manually manipulate the scrubbing and suction device. The flexible tube discharges water-containing debris into an open-air filtration tube 25, which is fitted with a filtration element 26. The filtered water discharges directly below the filtration element 26, which is located above the pool water level 27. The liquid level in the filtration tube 25 is maintained by the balance between the amount of water-containing debris passing through the flexible tube 21 and the amount of filtered water discharged from the filtration element 26. Any reduction in filtration efficiency will result in increased water levels in the filter tube 25, and may even lead to overflow through opening 40, signaling that the filter element 26 should be replaced. The scrubbers and impellers continue to work efficiently despite a reduction in filtration efficiency, and the debris containing water is returned to the pool water due to the overflow of the filter tube 25. The connection 29 provides power to the motor drive unit in the suction chamber 20, which may be driven by an electrical power cord connected to a rechargeable battery or by a hydraulic power cord connected to a garden hose.

The key features of the open-air filtration cleaning device include, in combination, the features set forth below:

1. A suction chamber for collecting and discharging scrubbed debris in swimming pool or hot tub water;
2. The suction chamber being provided with flexible elastomeric elements having cut out pathways in a bottom region contacting swimming pool or hot tub inner surfaces for free flow of pool water into the chamber;
3. The suction chamber being mounted on four wheels for manual or automatic propulsion of the open-air filtration cleaning device;
4. The suction chamber having an enclosed mechanical drive source which comprises an electrical motor or a hydraulic motor;
5. The mechanical drive rotating two scrubbing brushes mounted on the bottom of the suction chamber in opposing directions, for scrubbing an inner surface of the pool or hot tub;
6. The suction chamber having a horizontal rotating impeller positioned above the scrubbing brushes, and powered by the mechanical drive;
7. The horizontal impeller sucking scrubbed debris with pool or hot tub water and discharging it into a flexible tubing outlet;
8. The flexible tubing outlet connecting to a floating platform or alternatively connecting to an open air filtering unit integral with or appended to the pole handle that is attached to the suction chamber which discharges debris containing water into an open air filtering tube with replaceable filter elements,
9. The open to air filtering tube discharging filtered clean water into the pool or hot tub,
10. The water level in the replaceable filter element and the open to air replaceable filtering tube being monitored to detect any decrease in the water filtering efficiency; and
11. The filter element being replaced when a decrease in filtering efficiency is observed.

Having thus described the invention in rather full detail, it will be understood that such detail need not be strictly adhered to, but that additional changes and modifications may suggest themselves to one skilled in the art, all falling within the scope of the invention as defined by the subjoined claims.

What is claimed is:

1. An open-air filtration cleaning device, comprising:

a. a suction chamber unit for collecting and discharging scrubbed debris in swimming pool or hot tub water;

b. said suction chamber unit being provided with flexible elastomeric elements and having cut out pathways in its' bottom region, and contacting the swimming pool's or hot tub's inner surfaces to thereby enable free flow of pool water into the chamber;

c. said suction chamber unit being mounted on four wheels for manual or automatic propulsion of the pool or tub cleaner;

d. said suction chamber unit having an enclosed mechanical drive source which comprises an electrical motor or hydraulic motor;

e. said mechanical drive rotating two scrubbing brushes mounted on the bottom of said suction chamber unit in opposing directions for scrubbing said inner surface of said pool or hot tub;

f. said suction chamber unit having a horizontal rotating impeller positioned above said scrubbing brushes, and powered by said mechanical drive;

g. said horizontal impeller sucking scrubbed debris with pool or hot tub water and discharging the water and entrained debris into a flexible tubing outlet positioned on top of said suction chamber unit;

h. said flexible tubing outlet being connected to and in communication with a platform above the water line in the swimming pool or hot tub, for discharging debris containing water into an open to air filtering tube with replaceable filter elements;

i. said open to air filtering tube discharging filtered clean water into the pool or tub;

j. monitoring means for monitoring water level in said replaceable filter element and open to air replaceable filtering tube to detect any decrease in water filtering efficiency; and k. signal means for alerting an operator of the device when filtering efficiency decreases, to facilitate replacing the filter element and thereby promote reliable filtration of said pool or hot tub.

2. An open-air filtration cleaning device as recited by claim 1, wherein said elastomeric element is composed of rubber.

3. An open-air filtration cleaning device as recited by claim 1, wherein said manual propulsion of said suction chamber unit is accomplished by moving a pole attached to a side wall of said suction chamber.

4. An open-air filtration cleaning device as recited by claim 1, wherein said automatic propulsion of said suction chamber unit is accomplished by manipulating a pole attached to the side wall of said suction chamber unit.

5. An open-air filtration cleaning device as recited by claim 1, wherein said mechanical drive source is an electrical motor connected to outlet power.

6. An open-air filtration cleaning device as recited by claim 1, wherein said mechanical drive source is an electrical motor connected to battery power.

7. An open-air filtration cleaning device as recited by claim 1, wherein said mechanical drive source is a hydraulic motor or turbine connected to a garden hose water supply.

8. An open-air filtration cleaning device as recited by claim 1, wherein said platform is a floating platform comprising a spout and a filtration tube having a filter element.

9. An open-air filtration cleaning device as recited by claim 1, wherein said platform comprises a spout and a filtration tube having a filter element attached to a manual propulsion pole.

* * * * *